US005228902A

United States Patent [19]

Bogan et al.

[11] Patent Number: 5,228,902

[45] Date of Patent: Jul. 20, 1993

[54] METHOD OF DESULFURIZATION IN VACUUM PROCESSING OF STEEL

[75] Inventors: Robert S. Bogan, Natrona Heights, Pa.; Brad Hjerpe, Hebron, Ind.; Roger L. Marquart, Valparaiso, Ind.; James D. Reisinger, Hebron, Ind.

[73] Assignee: USX Corporation, Pittsburgh, Pa.

[21] Appl. No.: 941,203

[22] Filed: Sep. 3, 1992

[51] Int. Cl.[5] ..... C21C 7/02

[52] U.S. Cl. ..... 75/508

[58] Field of Search ..... 75/508

[56] References Cited

U.S. PATENT DOCUMENTS

| | | | |
|---|---|---|---|
| 4,277,279 | 7/1981 | Kerlin et al. | 75/53 |
| 4,341,554 | 7/1982 | Koros et al. | 75/58 |
| 4,517,015 | 5/1985 | Inaba et al. | 75/12 |
| 4,661,151 | 4/1987 | Endoh et al. | 75/53 |
| 4,944,798 | 7/1990 | Otatani | 75/508 |

FOREIGN PATENT DOCUMENTS

| | | |
|---|---|---|
| 254216 | 2/1988 | Fed. Rep. of Germany . |
| 48-009971 | 2/1973. | Japan . |
| 53-017523 | 6/1978 | Japan . |
| 57-067111 | 4/1982 | Japan . |
| 82112262 | 1/1984 | Japan . |
| 63-018646 | 4/1988 | Japan . |
| 1-129925 | 5/1989 | Japan . |

*Primary Examiner*—Peter D. Rosenberg

*Attorney, Agent, or Firm*—W. F. Riesmeyer, III; J. R. Pegan

[57] ABSTRACT

A method for desulfurizing molten steel while the steel is subjected to a vacuum dehydrogenation treatment, comprising adding to the steel in a vacuum chamber a desulfurizing agent in lump form and comprising, by weight percent, about 50% CaO, about 38% $CaF_2$, and about 10% MgO.

10 Claims, No Drawings

METHOD OF DESULFURIZATION IN VACUUM PROCESSING OF STEEL

BACKGROUND OF THE INVENTION

1. Field of the Invention

This invention relates to the desulfurization of steel being vacuum treated in a vacuum degassing unit such as an RH degasser, with use of a desulfurization agent comprising calcium oxide, calcium fluoride and magnesium oxide in lump form added to the steel in the vacuum chamber of the degasser.

2. Description of Related Art

U.S. Pat. No. 4,661,151 discloses a first treating agent for steel desulfurization comprising CaO, $CaF_2$, and from 10 to 60 weight % MgO, which agent, in fine powder form, is injected, with the aid of an inert carrier gas, into a ladle of molten steel and below a passage extending downwardly through a slag layer on the metal in the ladle and upwardly leading to an inert atmosphere treating chamber or a reduced pressure treating chamber such as an RH degassing apparatus. The desulfurization agent has a weight ratio of $(\%CaF_2)/[(\%CaO)+(\%CaF_2)]\times 100\%=20$ to 80%. The inert gas and entrained fine desulfurizer particles float upward through the passage and into the treating chamber. The CaO and $CaF_2$ serve as desulfurizers, and the MgO serves to protect the refractories in the equipment from erosion. A second desulfurization treating agent, comprising CaO and $CaF_2$, also is used.

In U.S. Pat. No. 4,517,015 there is disclosed a steel refining method comprising blowing an inert gas into the steel from below and from above the surface of a slag overlying the molten steel. The inert gas can carry a desulfurization agent.

U.S. Pat. No. 4,341,554 discloses a steel desulfurization process in which molten metal in a ladle is covered with a synthetic slag, particulate lime, of a size retained on a number 80 sieve, is added to cover the slag, then finely powdered lime is injected below the slag surface and rises in the bath to combine with the larger lime particles to form a crust which deters entry of air into the bath.

In U.S. Pat. No. 4,277,279, there is disclosed a method and apparatus for dispensing a fluidized stream of particulate material useful for desulfurization of molten ferrous metals.

German patent application 254,216 A1 shows and describes a method of desulfurizing molten metal in an RH type treatment apparatus, wherein a solid calcium-containing desulfurizing agent, in filled wire form, is injected, without a carrier gas, into one leg of the RH vessel after the melt has been vacuum deoxidized and before it has been vacuum dehydrogenated. Sulfur thereby is reduced to below 0.005%, with Hz below 3 ppm.

Japanese published application No. 1129925 discloses addition, to molten steel in an RH vessel, a treating agent comprising Fe-Ca-Ni-Si, Ni-Ca, Ni-Fe-Ca or Cu-Ca alloy, or briquetted Fe-Ca, and coated with refractory and/or iron powder particles, in order to improve yield.

Japanese patent no. 82-112262 (WPI Access No. 84-039724/07) discloses use of an agent for desulfurizing stainless steel in a ladle, wherein the agent, comprising $Cao-Al_2O_3-CaF_2$ and in amount of 13–16 kg/ton of steel, is added to the ladle before the steel melt is treated in an RH apparatus.

Japanese patent no. 1301814 discloses a method of refining steel by adding CaO to a ladle, filling the ladle and adding aluminum to the slag while blowing with Ar, then treating the steel in a vacuum degassing vessel with added MgO to solidify the slag.

Japanese 57067111 and 88-018646 (priority Jp 80-142220) discloses use of a calcium oxide-silica slag in a vacuum degassing vessel to control unelongatable non-metallic inclusions in a high-carbon steel to a low level.

Japanese 78017523 and 48009971 (priority JP 71-42943) discloses placing calcined lime on the bottom of a vacuum degassing vessel before introducing molten steel therein. The lime is sinter-bonded to the vessel bottom by residual heat of the vessel and does not float to the surface of the molten metal during vacuum treatment.

SUMMARY OF THE INVENTION

The method of this invention provides a desulfurization agent comprising, for example, about 50% CaO, about 38% $CaF_2$ and about 10% MgO in size range of about ½ inch to about 2 inches. The desulfurization agent is introduced into the treatment chamber of a vacuum degassing vessel, e.g. an RH degassing vessel, through a vacuum lock, and the degassing and dehydrogenating treatment is carried out in the presense of the desulfurization agent.

DETAILED DESCRIPTION OF THE INVENTION

The production of ultra-low sulfur steels requires that desulfurization steps be taken thoughout the steelmaking process. A prior art practice has been developed wherein finely powdered desulfurizing agents are blown, in an inert gas carrier, through tuyeres in the up leg of an RH degassing vessel, or as discussed above in connection with U.S. Pat. No. 4,661,151, through a lance into the ladle. It is claimed that the injection of the desulfurization agent and the mixing reaction in the vessel chamber both are needed for good sulfur removal.

However, such methods of desulfurization have some significant disadvantages such as the requirements for injection and blowing equipment additional piping to the vessel for the powder, special tuyeres or lances, and maintenance of all such additional equipment.

These disadvantages are avoided by the present invention in which lump desulfurization agent is added directly to the vacuum chamber of a vacuum degassing vessel such a the RH apparatus which has two dependent legs for insertion into a ladle of molten metal to be treated. The metal is sucked up one leg and flows down the other, providing a circulation path so that all the molten metal in the ladle can be treated effectively. Contrary to the mentioned prior art process of injection of powdered agent into the up leg of an RH vessel, the present invention also is applicable to use with the DH degassing vessel which has only one depending leg.

Since the particle size of the desulfurizing agent as used in this invention is much greater than that used in prior art injection processes, with correspondingly lesser surface area for reaction with sulfur in the molten metal, a powerful desulfurizing action is needed. Accordingly, the preferred composition of the desulfurizing agent is about 50% CaO, about 38% $CaF_2$ along with about 10% MgO, but may range from about 70% to about 40% for CaO, from about 50% to about 10% for $CaF_2$ and from about 20% to about 5% for MgO. The lime and fluorspar provide excellent desulfurization and the magnesium oxide affords substantial protection against erosion of the vessel refractories. A desulfurizer size range from about ¼ inch to about 3 inches diameter, especially about ½ inch to about 2 inches is possible; under 1 inch maximum diameter is preferred. This material is fed into the vacuum chamber through vacuum lock hoppers.

The method of the invention uses all existing equipment and so avoids the expenses and other difficulties encountered with specialized equipment for powder injection or for wire injection as disclosed in German patent application 254 216 A1.

In operation, a ladle of steel is processed at a ladle metallurgy furnace (LMF) to have a deoxidized bulk slag high in CaO, for example, 50% or greater, and a high aluminum level in the steel, for example above about 0.035%. The ladle then is transferred to the RH vessel for vacuum treatment. During reduction of pressure in the treatment chamber, for example, to about 1.0 max. torr, a batch addition of desulfurizer is made, for example, up to 500 pounds, depending on the heat size and the amount of sulfur removal which is required. The mixing action of the vessel, the fluidity of the flux, and the sulfur capacity of the bulk slag in the ladle all then influence the sulfur removal. Normally, if the sulfur content of the steel arriving at the vacuum degasser is from 0.004 to 0.005%, about 500 pounds of desulfurizer is needed and is added at approximately 60 seconds under vacuum. If arrival sulfur content is 0.006% or higher, another 500 pounds of desulfurizer is added after about three minutes.

Normal treatment time under vacuum is about 10–15 minutes for optimum desulfurization and hydrogen removal. Aluminum content is maintained at at least about 0.040% at vacuum break.

Experience on a commercial scale has shown that sulfur removal in excess of 50% is achieved, without excessive refractory wear. Examples of practice of the inventive method are set out in Table 1 below.

TABLE 1

| Heat No. | pounds de-S | sulfur, % 1v. LMF | 1v. RH | final | %S removal | Time, Min. de-S add. to vac. break |
|---|---|---|---|---|---|---|
| T25540 | 500 | .005 | .003 | .001(1) | 40 (80) | 05 |
| T25544 | 500 | .008 | .005 | .004 | 50 | 08 |
| Y29311 | 1000(2) | .006 | .002 | .002 | 67 | 11-05 |
| T25542 | 1000(2) | .008 | N.T. | .004 | 50 | 07-05 |
| T25543 | 1000(2) | .009 | .006 | .004 | 56 | 04-01 |

(1)Heat sent back to LMF for arcing and CaSi wire addition, resulting in an additional 0.002% S removal. All other heats went directly from the RH unit to a continuous caster, with no additional processing.
(2)500 pounds/batch All of the above desulfuriztion tests were with approximately 220 ton heats of Si-Al killed plate grades of steel. Temperature loss was observed to be about 10° F. per 1000 pounds of added desulfurizer.

In each case, furnace slag was skimmed from the heat to reduce MnO and FeO, and standard flux additions (pebble lime and calcium aluminate) were then added. Each heat was then deoxidized in the LMF with the basic slag and aluminum addition, arced for about 5 minutes maximum between additions, and Ar-stirred to maximize desulfurization in the ladle. Aim Al content was 0.050%.

What is claimed is:

1. A method of desulfurizing molten steel, comprising introducing the molten steel from a ladle into a vacuum chamber of a vacuum degassing apparatus and therein subjecting the molten steel to a vacuum dehydrogenation treatment, adding to the molten steel in the vacuum chamber a desulfurizing agent in solid lump form and comprising calcium oxide, calcium fluoride and magnesium oxide and desulfurizing the steel while it is subjected to vacuum dehydrogenation treatment.

2. A method according to claim 1, wherein the vacuum degassing apparatus is an RH degasser.

3. A method according to claim 2, wherein the desulfurizing agent comprises from about 70 wt. % to about 40 wt. % CaO, from about 50 wt. % to about 10 wt. % $CaF_2$, and from about 20 wt. % to about 5 wt. % MgO.

4. A method according to claim 3, wherein the desulfurizing agent comprises about 50% CaO, about 38% $CaF_2$, and about 10% MgO.

5. A method according to claim 3, wherein the steel contained in the ladle is covered with a basic desulfurizing and deoxidizing slag comprising lime and calcium aluminate.

6. A method according to claim 5, wherein the steel introduced into the vacuum degassing chamber contains over 0.003 wt. % and up to about 0.010 wt. % sulfur and at least about one-half of the sulfur content of the steel is removed in the desulfurization treatment.

7. A method according to claim 6, wherein, when the initial sulfur content of the steel is in the range from 0.004 to 0.005 wt. %, desulfurizer is added in a single batch to the vacuum degassing chamber, and when the initial sulfur content of the steel is about 0.006 wt. % or higher, desulfurizer is added in multiple batches of a number sufficient to reduce the sulfur content of the steel to about 0.003 wt. % or less.

8. A method according to claim 7, wherein the combined desulfurization and dehydrogenation treatment is carried out for a period of at least about 10 minutes.

9. A method according to claim 1, wherein the desulfurizing agent has an average particle size from about ¼ inch to about 3 inches.

10. A method according to claim 9, wherein the desulfurizing agent has an average maximum particle size less than about 1 inch.

* * * * *